US006297841B1

(12) United States Patent
Takeda

(10) Patent No.: US 6,297,841 B1
(45) Date of Patent: Oct. 2, 2001

(54) THERMOSENSITIVE RECORDING METHOD AND APPARATUS

(75) Inventor: Kazuhiro Takeda, Shizuoka (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/272,677

(22) Filed: Mar. 19, 1999

(30) Foreign Application Priority Data

Mar. 19, 1998 (JP) ..... 10-070633Q

(51) Int. Cl.[7] ..... B41J 2/38
(52) U.S. Cl. ..... 347/186
(58) Field of Search ..... 347/218, 185, 347/186, 187; 400/120.08; B41J 2/38

(56) References Cited

FOREIGN PATENT DOCUMENTS

| | | |
|---|---|---|
| 0409201 | 1/1991 | (EP) . |
| 54-53546 | 4/1979 | (JP) . |
| 62-135382 | 6/1987 | (JP) . |
| 62193851 | 8/1987 | (JP) . |
| 62-199348 | 12/1987 | (JP) . |
| 2-217269 | 8/1990 | (JP) . |
| 3-289857 | 12/1991 | (JP) . |
| 3297687 | 12/1991 | (JP) . |
| 5268436 | 10/1993 | (JP) . |
| 7-68827 | 3/1995 | (JP) . |
| 8-174893 | 7/1996 | (JP) . |
| 8-336998 | 12/1996 | (JP) . |
| 9-254426 | 9/1997 | (JP) . |

OTHER PUBLICATIONS

United Kingdom Search Report issued Dec. 20, 1999 in a related application. (GB 9905760.6).

*Primary Examiner*—N. Le
*Assistant Examiner*—K. Feggins
(74) *Attorney, Agent, or Firm*—Ostrolenk, Faber, Gerb & Soffen, LLP

(57) ABSTRACT

A thermally sensitive printing apparatus and method checks the temperature of a recording device after rolling back a recording medium to a ready position. If the temperature is below a first predetermined value, a warm-up operation is performed allowing the recording medium to be fed through the apparatus at normal operating speed. If the temperature is below a second predetermined value, the recording medium is either fed through the apparatus at a reduced speed or more energy is sent to the recording device while feeding recording medium at the normal operating speed.

22 Claims, 4 Drawing Sheets

THERMOSENSITIVE RECORDING METHOD AND APPARATUS

BACKGROUND OF THE INVENTION

1. Field of the Invention

The present invention relates to a thermosensitive recording method and thermosensitive recording apparatus and in particular, to a thermosenstivie recording method and thermosensitive recording apparatus in which a recording condition is changed according to a temperature of a recording device.

2. Description of the Related Art

Conventionally, this type of photosensitive recording method and apparatus have been used for reducing a recording time while maintaining a sufficient print concentration such as a character and a symbol on a recording paper. Moreover, a technique utilizing a recording device temperature is disclosed, for example, in Japanese Patent Publication (unexamined) A-5-268436 and A-3-297687, in which a recording device temperature is automatically supplied to a register so that the register can be read when required, thus enabling to reduce the CPU load. Japanese Patent Publication (unexamined) A-62-193851, in which thermosensitive recording apparatus having sift resistor to control ON/OFF of drive device. Object of this related art is reduction of energy consumption.

FIG. 4 is a block diagram showing this conventional photosensitive recording apparatus that comprises: a recording device 42 for printing on a recording paper with a print energy generated when a voltage is applied; a temperature sensor 43 for detecting a temperature of the recording device 42; a cutter for cutting the recording paper; a drive block 44 for feeding the recording paper; a position sensor for detecting a leading edge of the recording paper; and a recording controller 41 which operates as follows. That is, upon reception of a record start command, the record controller 41 checks the temperature shown by the temperature sensor 43.

If the check result is equal to or above a predetermined temperature (for example, 25 degrees C.), the record controller 42 sets a predetermined normal speed (for example V=13 mm/sec) as the recording paper feed speed during a recording operation for printing on the recording paper, and a predetermined normal print energy as the print energy of the recording device 42. For example, the normal print energy is such that when a printing is performed at the normal recording paper feed speed with the recording device 42 at a temperature of 25 degrees C., or above, it is possible to obtain a sufficient print concentration as a black ratio representing a ratio of a print area occupied by black.

Moreover, if the aforementioned check result is below 25 degrees C., in order to obtain a predetermined black ratio or above, the recording paper feed speed is set lower than the normal speed during a recording operation and the print energy of the recording device 42 is set to the normal print energy; or the recording paper feed speed is maintained at the normal speed and the print energy of the recording device 42 is set higher than the normal print energy.

Next, explanation will be given on the operation of the conventional photosensitive recording apparatus.

The record controller 41, upon reception of a record start command, checks the temperature indicated by the temperature sensor 43 and stores the temperature value. Next, the record controller 41 performs a roll-back operation. That is, the recording paper which has been waiting with its leading edge at a wait position 47 is rolled back to a record start position 48 by a drive block 44.

If the check result stored is equal to or above 25 degrees C., the record controller 41 causes the drive block 44 to feed the recording paper at a normal speed and supplies to a recording device 42 a printing pulse indicating a printing period (print energy generation period) from a print start to a print end. The printing device 42 is made to print on the printing paper with a normal print energy. In this case, the printing state is equal to or above a predetermined black ratio and brings about a sufficient print concentration.

Moreover, if the check result stored is below 25 degrees C., in order to obtain a print state of sufficient print concentration equal to or above the predetermined black ratio, the drive block 44 is operated so as to feed the recording paper at a lower speed than the normal speed while the recording device 42 prints on the printing paper with the normal print energy, or the drive block 44 is operated so as to feed the recording paper at the normal speed while the print pulse is supplied to the recording device 42 so as to print on the recording paper with a higher print energy than the normal print energy.

In the aforementioned thermosensitive recording apparatus, when the recording device temperature is below 25 degrees C., in order to obtain a print state equal to or above a predetermined black ratio, there is a necessity to slow down the print speed (recording paper feed speed) or increase the recording device print energy.

SUMMARY OF THE INVENTION

It is therefore an object of the present invention to provide a thermosensitive recording method and apparatus capable of obtaining a sufficient print concentration of characters and symbols with a sufficient black ratio without lowering the print speed (recording paper feed speed) or increasing the recording device print energy in many circumstances even when the recording device temperature is below 25 degrees C.

In order to achieve the aforementioned object, in the thermosensitive recording method according to the present invention, a recording device is warmed up prior to a recording. That is, while a recording paper is rolled back at a predetermined feed speed prior to recording, a predetermined print energy is applied to the recording device to perform a pseudo-printing, i.e., a printing operation not causing a black point on the recording paper.

The thermosensitive recording apparatus according to the present invention comprises:

- a recording device for printing on a recording paper with a predetermined print energy;
- a temperature sensor for detecting a temperature of the recording device;
- a drive block for feeding the recording paper; and
- a recording controller which upon reception of a predetermined command, checks a temperature indicated by the temperature sensor so as to decide according to a result of the check whether to perform a warm up of the recording device while the recording paper is rolled up from a wait position to a recording start position, and to determine a feed speed of the recording paper and a print energy to be applied to the recording device during a printing.

Furthermore, the recording controller controls the apparatus as follows:

- if the temperature of the recording device is equal to or above a first threshold, then the warm up is not performed, the feed speed of the recording paper is set to a first speed, and the print energy to be applied to the recording device is set to a first print energy;

if the temperature of the recording device is below the first threshold value and above or equal to a second threshold value, then the warm up is performed, the feed speed is set to the first speed, and the print energy is set to the first print energy; and if the temperature of the recording device is below the second threshold value, then the warm up is performed, and the feed speed is set to a second speed lower than the first speed in combination with setting of the first print energy, or the feed speed is set to the first speed in combination with setting of a second print energy higher than the first print energy.

Moreover, in the thermosensitive recording apparatus according to the present invention, the warm up operation is performed by applying a predetermined third print energy to the recording device to perform a pseudo-printing without causing a black point on the recording paper while the recording paper is rolled back at a predetermined third speed.

DESCRIPTION OF THE PREFERRED EMBODIMENTS

Hereinafter, description will be directed to an embodiment of the present invention with reference to the attached drawings.

Figure 1:
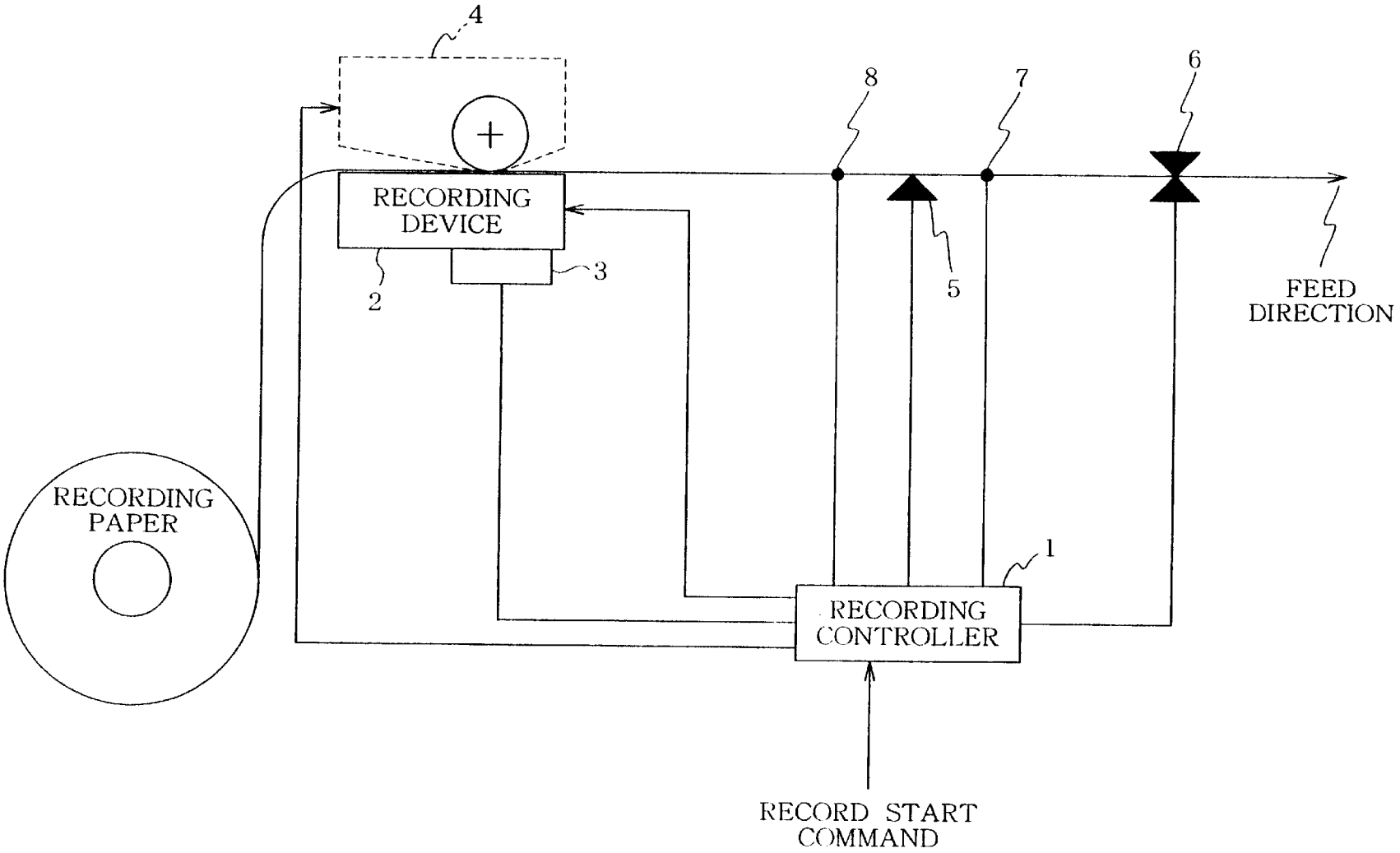
FIG. 1 is a block diagram showing a thermosensitive recording apparatus according to an embodiment of the present invention.

FIG. 1 is a block diagram showing a thermosensitive recording apparatus according to the embodiment of the present invention.

The thermosensitive recording apparatus shown in FIG. 1 includes: a recording device 2 for recording a character and a symbol by printing on a recording paper by a print energy generated when a voltage is applied; a temperature sensor 3 for detecting the temperature of the recording device 2; a drive block 4 having, for example, a platen roller for feeding the recording paper; and a recording controller that checks a temperature indicated by the temperature sensor 3 upon reception of a record start command, so as to use the check result to decide whether to perform a warm-up operation for warming the recording device 2 while the recording paper is rolled back by the drive block 4 prior to starting a recording, and to determine the recording paper feed speed during a recording operation for printing on the recording paper by the recording device 2 as well as the print energy of the recording device 2.

If the check result of the temperature indicated by the temperature sensor 3 is equal to or above a predetermined first temperature (for example, 25 degrees C.), the recording controller 1 determines not to perform the warm-up operation, and to set a predetermined first speed (hereinafter, referred to as a normal speed which may be V=13 mm/sec, for example) for the recording paper feed speed during a recording operation and a predetermined first print energy (hereinafter, referred to as a normal print energy) for the print energy of the recording device 2. The normal print energy is an energy enabling to obtain a predetermined black ratio assuring a sufficient print concentration of a character or symbol printed at the normal speed when the temperature of the recording device 2 is equal to or above the first temperature. Here, the relationships between the print concentration, a voltage applied to the recording device 2, the recording paper feed speed, and the black ratio should be made clear beforehand by an experiment.

Moreover, if the check result of the temperature indicated by the temperature sensor 3 is below the first temperature but above or equal to a predetermined second temperature (for example, 20 degrees C.), the recording controller 1 determines to perform the warm-up operation, and to set the normal speed for the recording paper feed speed during a recording operation and the normal print energy for the print energy of the recording device 2.

Furthermore, if the check result of the temperature indicated by the temperature sensor 3 is below the second temperature, then the recording controller 1 determines to perform the warm-up operation, and either to set a second speed (hereinafter, referred to as a slow speed) slower than the normal speed for the recording paper feed speed during a recording operation, and the normal print energy for the print energy of the recording device 2; or to set the normal speed for the recording paper feed speed, and a second print energy (hereinafter, referred to as a high print energy) higher than the normal print energy.

Here, the warm-up operation is performed for warming the recording device 2 during a roll-back operation, so that even if the temperature of the recording device 2 is below the first temperature, it is possible to obtain a sufficient print concentration by feeding the recording paper at a speed slightly slower than the normal speed and printing by the recording device 2 with a print energy slightly lower than the normal print energy.

It should be noted that FIG. 1 also shows a cutter 6 for cutting of the recording paper and a position sensor 5 for detecting the leading edge of the recording paper.

Next, a detailed explanation will be given on the operation of the photosensitive recording apparatus according to an embodiment of the present invention with reference to FIG. 2 and FIG. 3.

Figure 2:
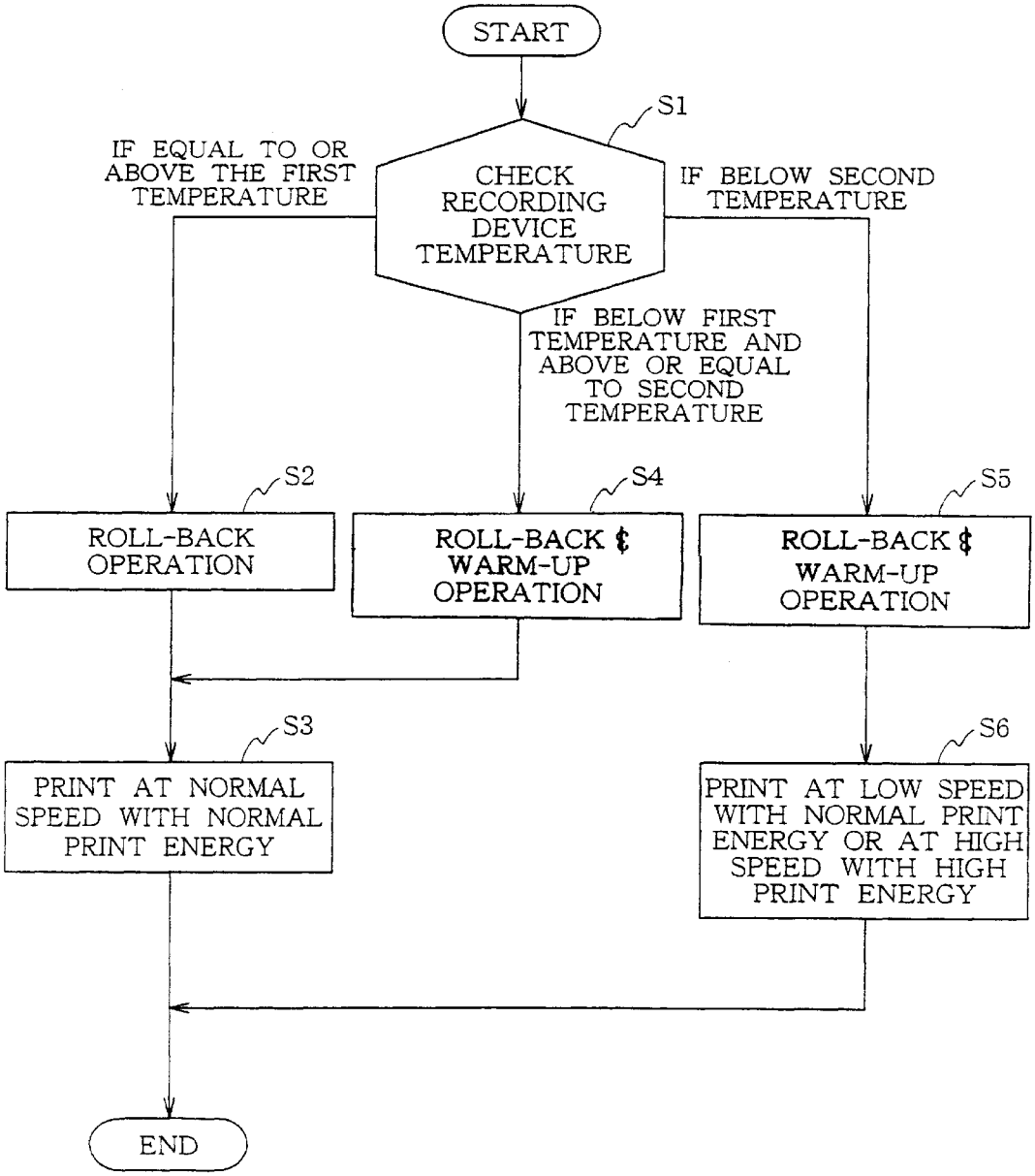
FIG. 2 is a flowchart showing an operation example of the embodiment.

FIG. 2 is a flowchart showing an operation example of the embodiment of the present invention.

Figure 3:
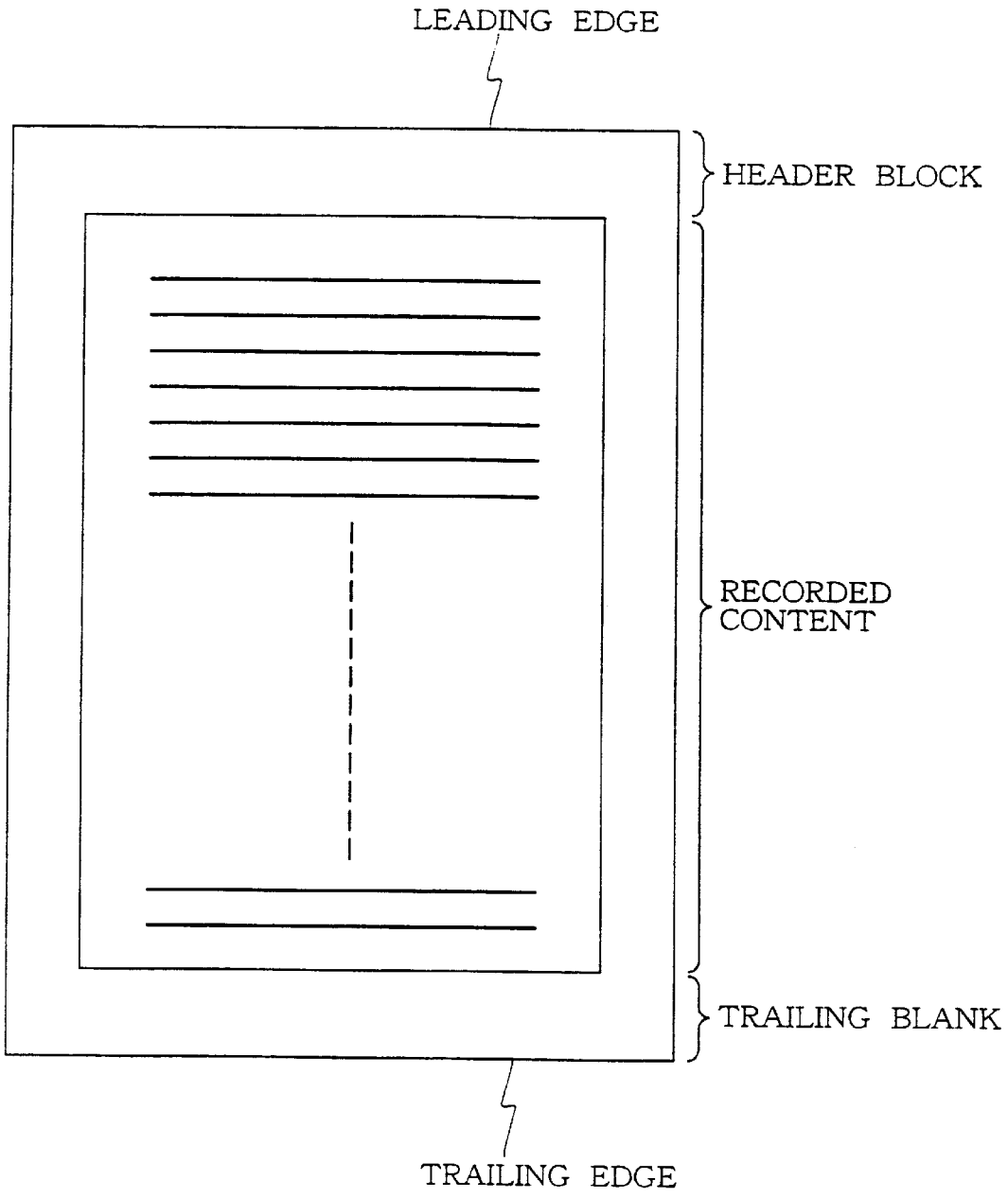
FIG. 3 shows an example of a recording paper state after a recording.
Figure 4:
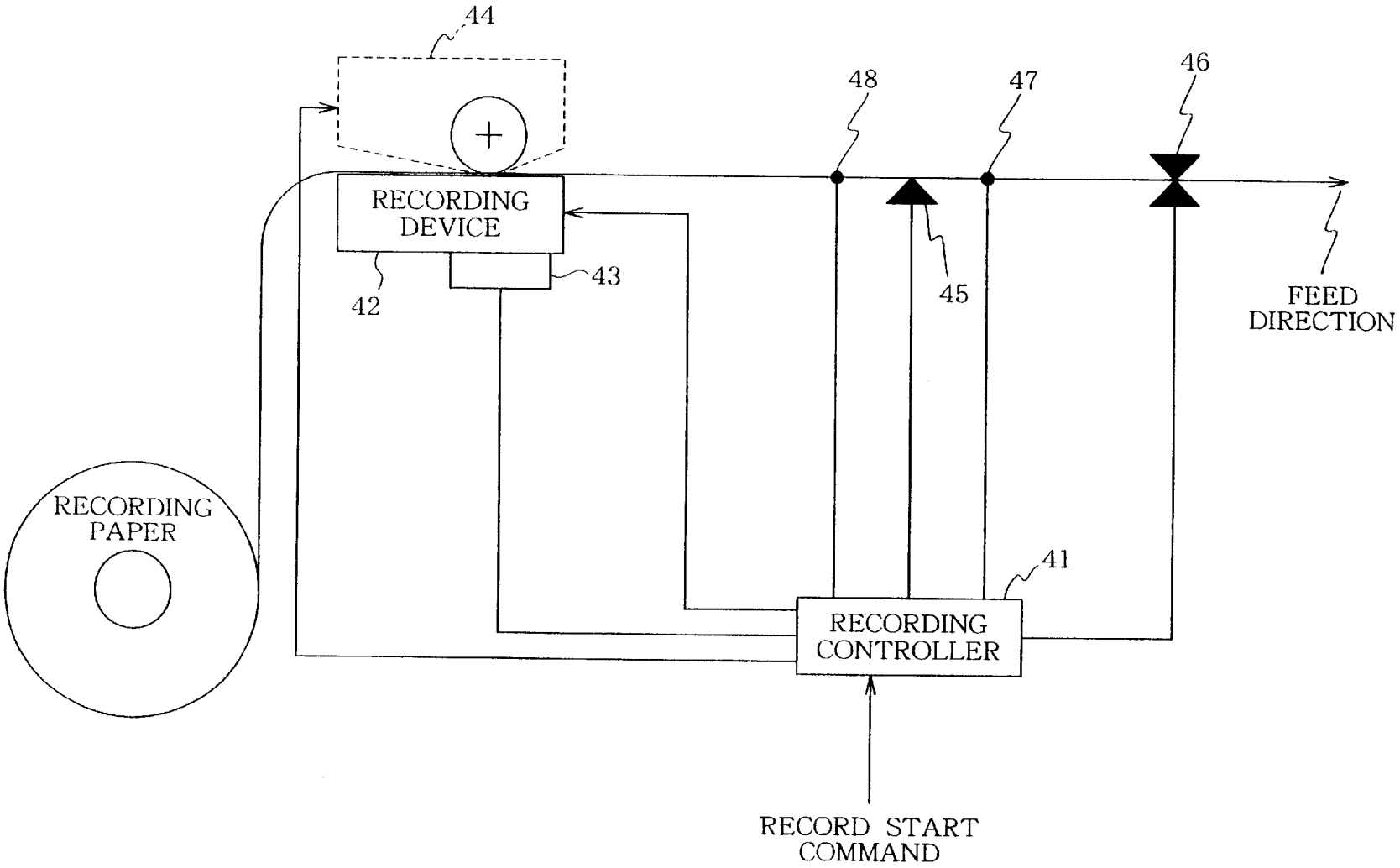
FIG. 4 PRIOR ART
FIG. 4 is a block diagram showing a conventional thermosensitive recording apparatus.

FIG. 3 shows a state of the recording paper after printing, including a recorded content sandwiched by a header blank and a trailing blank.

Referring back to FIG. 1, upon reception of a record start command, the recording controller 1 checks a temperature indicated by the temperature sensor 3 (step S1).

If the check result is equal to or above the predetermined first temperature, the roll-back operation is performed so as to set the leading edge of the recording paper at the record start position. That is, after cutting off a sheet by the cutter 6, the recording paper is rolled back so that its leading edge is set at the wait position 7. The recording paper is then detected by the position sensor 5 and the recording paper is further rolled back to set its leading edge at the record start position 8 (step S2).

The drive block 4 is operated to feed the recording paper at the normal speed, and to supply to the recording device 2 a print pulse indicating a print period (print energy generation period) from a print start to print end, so that the recording device 2 is made to print on the recording paper with the normal print energy (step S3). (Here, a sufficient print concentration, i.e., a predetermined black ratio or more can be obtained.)

Moreover, if the result of the check performed in step S1 is below the first temperature but equal to or above the second temperature, the warm-up operation is performed. That is, the roll-back operation is performed in step S2, during which a print pulse is applied to the recording device 2 so as to make the recording device 2 print (step S4) with a third print energy (for example, 0.1 J) without causing a black point on the recording paper. Control is passed to step S3.

Furthermore, if the result of the check performed in step S1 is below the second temperature, the warm-up operation is performed (step S5) and control is passed to step S6. In order to obtain a sufficient print concentration with a predetermined black ratio or above, in step S6, the drive block 4 is operated so as to feed to the recording paper at the low speed, and a print pulse is applied to the recording device 2 so that the recording device 2 prints on the recording paper with the normal print energy; or the drive block 4 is operated so as to feed the recording paper at the normal speed, and a print pulse is applied to the recording device 2 so that the recording device 2 prints on the recording paper with the high print energy.

In the above explanation, the warm-up operation is performed through the roll-back operation at the third speed and the printing by the recording device 2 with the third print energy. However, the third speed and the third print energy may be modified, depending on the temperature of the recording device 2.

As has been described above, in the thermosensitive recording method and apparatus according to the present invention, temperature of the recording device is checked at a record start and in a case when the check result is below a predetermined first temperature (for example, 25 degrees C.), warm-up operation is performed to the recording device during a roll-back of the recording paper prior to the record start; in a case if the check result is below the first temperature but equal to or above a second temperature (for example, 20 degrees C.), after the roll-back operation, the recording paper is fed at the normal speed and the recording device is made to print with the normal print energy on the recording paper; and in a case when the check result is below the second temperature, after the roll-back operation, the recording paper is fed at the low speed and the recording device is made to print on the printing paper with the normal print energy, or the recording paper is fed at the normal speed and the recording device is made to print on the recording paper with the high print energy.

Accordingly, when the recording device has a temperature below the first temperature but equal to or above the second temperature, the normal (feed) speed and the normal print energy can be employed. That is, without reducing the print speed (recording paper feed speed) or increasing the print energy of the recording device, it is possible to obtain a sufficient black ratio for a sufficient print concentration of a character or symbol. Moreover, even when the recording device has a temperature below the second temperature, it is possible to obtain a sufficient black ratio for a sufficient print concentration of a character or symbol by only slightly reducing the print speed (recording paper feed speed) to a speed which is yet faster than the conventional speed, and slightly increasing the print energy of the recording device, which is higher than the normal print energy but lower than the conventional print energy employed at that temperature.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 10-070633 Filed on Mar. 19$^{th}$, 1998) including specification, claims, drawings and summary are incorporated herein by reference in its entirety.

What is claimed is:

1. A method of operating a printer including a recording device operable to print an image on a thermosensitive recording medium, a feed mechanism for the recording medium and a controller, the method comprising:

establishing first, second and third printer speed-print energy combinations for the feed mechanism and the recording device;

generating a start signal indicating the beginning of a printing operation;

determining the temperature of the recording device in response to the start signal;

operating the controller in response to the determined temperature being equal to or higher than a first temperature to activate the feed mechanism to move the recording medium from a wait position to a print start position, and thereafter operating the recording device and the feed mechanism to print an image on the recording medium using the first printer speed-print energy combination;

operating the controller in response to the determined temperature being below the first temperature, but equal to or higher than a second temperature to preheat the recording device while activating the feed mechanism to move the recording medium from the wait position to the print start position using the third printer speed-print energy combination, and thereafter operating the recording device and the feed mechanism to print an image on the recording medium using the first printer speed-print energy combination; and operating the controller in response to the determined temperature being lower than the second temperature to preheat the recording device while activating the feed mechanism to move the recording medium from the wait position to the print start position using the third printer speed-print energy combination, and thereafter operating the recording device and the feed mechanism to print an image on the recording medium using the second printer speed-print energy combination.

2. The method of operating a printer as described in claim 1, wherein the controller operates the feed mechanism to move the recording medium from the wait position to the print start position at a speed depending on the determined temperature.

3. The method of operating a printer as described in claim 1, further including the step of varying the third printer speed-print energy combination in accordance with the detected temperature.

4. The method of operating a printer as described in claim 1, wherein the printer speeds of the first and second printer speed-print energy combinations are equal and the print energy of the first printer speed-print energy combination is less than the print energy of the second printer speed-print energy combination.

5. The method of operating a printer as described in claim 1, wherein the print energies of the first and second printer speed-print energy combinations are equal and the printer speed of the first printer speed-print energy combination is greater than the printer speed of the second printer speed-print energy combination.

6. The method of operating a printer as described in claim 1, wherein the controller operates the feed mechanism in a first direction to move the recording medium from the wait position to the print start position, and operates the feed mechanism in a second direction opposite to the first direction to move the recording medium during printing.

7. A printing apparatus comprising:

a recording device operable to print an image on a thermosensitive recording medium;

a feed mechanism for the recording medium;

a temperature sensor that measures the operating temperature of the recording device;

a circuit that generates a start signal indicating the beginning of a printing operation; and a controller, the controller being operative to establish first, second and third printer speed-print energy combinations for the feed mechanism and the recording device;

the controller being responsive to the start signal to determine the temperature of the recording device measured by the temperature sensor, the controller being responsive to the measured temperature being equal to or higher than a first temperature to activate the feed mechanism to move the recording medium from a wait position to a print start position, and thereafter to operate the recording device and the feed mechanism to print an image on the recording medium using the first printer speed-print energy combination;

the controller being responsive to the measured temperature being below the first temperature, but equal to or higher than a second temperature to preheat the recording device while activating the feed mechanism to move the recording medium from the wait position to the print start position using the third printer speed-print energy combination, and thereafter to operate the recording device and the feed mechanism to print an image on the recording medium using the first printer speed-print energy combination; and the controller being responsive to the measured temperature being lower than the second temperature to preheat the recording device while activating the feed mechanism to move the recording medium from the wait position to the print start position using the third printer speed-print energy combination, and thereafter to operate the recording device and the feed mechanism to print an image on the recording medium using the second printer speed-print energy combination.

8. A printing apparatus as described in claim 7, wherein the controller operates the feed mechanism to move the recording medium from the wait position to the print start position at a speed depending on the determined temperature.

9. A printing apparatus described in claim 7, wherein the controller is operative to vary the third printer speed-print energy combination in accordance with the detected temperature.

10. A printing apparatus as described in claim 7, wherein the printer speeds of the first and second printer speed-print energy combinations are equal and the print energy of the first printer speed-print energy combination is less than the print energy of the second printer speed-print energy combination.

11. A printing apparatus as described in claim 7, wherein the print energies of the first and second printer speed-print energy combinations are equal and the printer speed of the first printer speed-print energy combination is greater than the printer speed of the second printer speed-print energy combination.

12. A printing apparatus as described in claim 7, wherein the controller operates the feed mechanism in a first direction to move the recording medium from the a wait position to the print start position, and operates the feed mechanism in a second direction opposite to the first direction to move the recording medium during printing.

13. A method of operating a printer including a recording device operable to print an image on a thermosensitive recording medium and a feed mechanism for the recording medium, the method comprising:

establishing first and second printer speed-print energy combinations for the feed mechanism and the recording device;

generating a start signal indicating the beginning of a printing operation;

determining the temperature of the recording device in response to the start signal;

operating the feed mechanism and the recording device in response to the determined temperature being equal to or higher than a first temperature to print an image on the recording medium using the first printer speed-print energy combination;

preheating the recording device in response to the determined temperature being below the first temperature, but equal to or higher than a second temperature and thereafter operating the recording device and the feed mechanism to print an image on the recording medium using the first printer speed-print energy combination; and preheating the recording device in response to the determined temperature being lower than the second temperature and thereafter operating the recording device and the feed mechanism to print an image on the recording medium using the second printer speed-print energy combination.

14. The method of operating a printer as described in claim 13, further including the steps of:

establishing a preheating energy level for the recording device; and operating the controller in response to the determined temperature being lower than the first temperature to preheat the recording device using the preheating energy level.

15. The method of operating a printer as described in claim 13, wherein the controller is operative to preheat the recording device at an energy level that varies in accordance with the detected temperature.

16. The method of operating a printer as described in claim 13, wherein the printer speeds of the first and second printer speed-print energy combinations are equal and the print energy of the first printer speed-print energy combination is less than the print energy of the second printer speed-print energy combination.

17. The method of operating a printer as described in claim 13, wherein the print energies of the first and second printer speed-print energy combinations are equal and the printer speed of the first printer speed-print energy combination is greater than the printer speed of the second printer speed-print energy combination.

18. A printing apparatus comprising:

a recording device operable to print an image on a thermosensitive recording medium;

a feed mechanism for the recording medium;

a temperature sensor that measures the operating temperature of the recording device;

a circuit that generates a start signal indicating the beginning of a printing operation; and a controller, the controller being operative to establish first and second printer speed-print energy combinations for the feed mechanism and the recording device and responsive to the start signal to determine the temperature of the recording device measured by the temperature sensor, the controller being responsive to the measured temperature being equal to or higher than a first temperature to activate the feed mechanism and the recording device to print an image on the recording medium using the first printer speed-print energy combination;

the controller being responsive to the measured temperature being below the first temperature, but equal to or higher than a second temperature to preheat the recording device and thereafter to operate the recording device and the feed mechanism to print an image on the recording medium using the first printer speed-print energy combination; and the controller being responsive to the measured temperature being lower than the second temperature to preheat the recording device and thereafter to operate the recording device and the feed mechanism to print an image on the recording medium using the second printer speed-print energy combination.

19. A printing apparatus as described in claim 18, wherein the controller is further operative to:

establish a preheating energy level for the recording device; and operative in response to the determined temperature being lower than the first temperature to preheat the recording device using the preheating energy level.

20. A printing apparatus as described in claim 18, wherein the controller is operative to preheat the recording device at an energy level that varies in accordance with the detected temperature.

21. A printing apparatus as described in claim 18, wherein the printer speeds of the first and second printer speed-print energy combinations are equal and the print energy of the first printer speed-print energy combination is less than the print energy of the second printer speed-print energy combination.

22. A printing apparatus as described in claim 18, wherein the print energies of the first and second printer speed-print energy combinations are equal and the printer speed of the first printer speed-print energy combination is greater than the printer speed of the second printer speed-print energy combination.

* * * * *